US006443589B1

(12) United States Patent
Lee

(10) Patent No.: US 6,443,589 B1
(45) Date of Patent: Sep. 3, 2002

(54) DRINKING VESSEL

(75) Inventor: Seungsoo Lee, Cliffside Park, NJ (US)

(73) Assignee: Joy World, Inc., Ridgefield Park, NJ (US)

( * ) Notice: Subject to any disclaimer, the term of this patent is extended or adjusted under 35 U.S.C. 154(b) by 0 days.

(21) Appl. No.: 09/684,256

(22) Filed: Oct. 6, 2000

Related U.S. Application Data

(60) Provisional application No. 60/159,708, filed on Oct. 15, 1999.

(51) Int. Cl.[7] ..... F21V 33/00

(52) U.S. Cl. ..... 362/101; 362/276; 362/802; 362/318; 362/394

(58) Field of Search ..... 362/276, 802, 362/101, 96, 124, 808, 318, 394

(56) References Cited

U.S. PATENT DOCUMENTS

| | | | | |
|---|---|---|---|---|
| 2,544,594 A | | 3/1951 | Goldfarb | |
| 2,663,866 A | | 12/1953 | Simpson | |
| 2,922,929 A | | 1/1960 | Cooper et al. | |
| 3,137,956 A | | 6/1964 | Morgan | |
| 3,314,189 A | | 4/1967 | Carroll | |
| 3,675,925 A | | 7/1972 | Ryan et al. | |
| 4,675,519 A | * | 6/1987 | Price | 250/209 |
| 4,765,465 A | | 8/1988 | Yamada et al. | |
| 4,865,575 A | | 9/1989 | Rosenthal | |
| 4,928,412 A | | 5/1990 | Nishiyama | |
| 4,941,590 A | | 7/1990 | Pantaleo et al. | |
| 5,013,276 A | | 5/1991 | Garfinkel | |
| 5,314,336 A | | 5/1994 | Diamond et al. | |
| 5,339,548 A | | 8/1994 | Russell | |
| 5,483,763 A | | 1/1996 | Liu | |
| 5,536,196 A | | 7/1996 | Sternberg | |
| 5,553,735 A | | 9/1996 | Kimura | |
| 5,557,867 A | | 9/1996 | Sugawara | |
| 5,739,903 A | | 4/1998 | Kepner | |
| 5,785,407 A | | 7/1998 | Ratcliffe et al. | |
| 5,990,790 A | * | 11/1999 | Lusareta | 340/571 |
| 6,163,248 A | * | 12/2000 | Paek et al. | 340/321 |

FOREIGN PATENT DOCUMENTS

| | | |
|---|---|---|
| WO | 9417691 | 8/1994 |

* cited by examiner

*Primary Examiner*—Sandra O'Shea
*Assistant Examiner*—Jacob Y. Choi
(74) *Attorney, Agent, or Firm*—Selitto, Behr & Kim

(57) ABSTRACT

A drinking vessel includes a container sized and shaped so as to hold liquid therein and a generating mechanism for generating electrically generated special effects so as to enhance amusement for a user. A first switch is mounted on the container so as to be operable between a first state, in which the first switch is in an electrically closed state, and a second state, in which the first switch is in an electrically open state. The first switch is in the first state when liquid is present in the container and in the second state when liquid is not present in the container. A second switch is also mounted on the container so as to be operable between a third state, in which the second switch is in an electrically closed state, and a fourth state, in which the second switch is in an electrically open state. The second switch is in the third state in response to a predetermined physical activity undertaken by the user in relation to the container. The first switch and the second switch are electrically connected to the generating mechanism such that the generating mechanism is activated to generate the special effects only when liquid is present in the container and when the predetermined physical activity is undertaken by the user.

22 Claims, 4 Drawing Sheets

DRINKING VESSEL

CROSS-REFERENCE TO RELATED APPLICATION

This is a non-provisional application relating to Provisional Patent Application Serial No. 60/159,708 filed Oct. 15, 1999.

FIELD OF THE INVENTION

The present invention relates to drinking vessels and, more particularly, to drinking vessels adapted to generate special effects in response to predetermined conditions.

BACKGROUND OF THE INVENTION

In the past, various drinking vessels have been developed for generating special effects in response to certain conditions of the drinking vessels for enhancing amusement for their users. For instance, International Publication No. WO 94/17691 discloses a cup adapted to generate sounds when the cup is filled with water and/or when the cup is emptied of same, while U.S. Pat. No. 5,339,548 discloses a glass adapted to display an image in response to the level of liquid therein. Although the cup and glass are responsive to liquid conditions, they are not adapted to generate special effects in response to their motion (e.g., lifting from or placement on a supporting surface).

U.S. Pat. Nos. 4,765,465, 5,536,196 and 5,785,407 relate to drinking vessels having generating mechanisms for generating sounds or lights in response to placement or lifting of the drinking vessels on or from a supporting surface. While these drinking vessels generate special effects when placed on or lifted from a supporting surface, they are not responsive to the presence or absence of liquid therein.

U.S. Pat. No. 5,553,735 discloses a vessel equipped with a sensor and light sources, such as light bulbs, which are mounted in a cavity of the vessel for activation in response to actuation of the sensor. It is believed that no provision is made in the vessel for controlling activation of the light sources in response to the presence or absence of liquid in the vessel.

SUMMARY OF THE INVENTION

The present invention overcomes the disadvantages and shortcomings of the prior art discussed above by providing a new and improved drinking vessel adapted to generate special effects in response to predetermined conditions. More particularly, the drinking vessel includes a container sized and shaped so as to hold liquid therein and a generating mechanism for generating electrically generated special effects so as to enhance amusement for a user. A first switch is mounted on the container so as to be operable between a first state, in which the first switch is in an electrically closed state, and a second state, in which the first switch is in an electrically open state. The first switch is in the first state when liquid is present in the container and in the second state when liquid is not present in the container. A second switch is also mounted on the container so as to be operable between a third state, in which the second switch is in an electrically closed state, and a fourth state, in which the second switch is in an electrically open state. The second switch is in the third state in response to a predetermined physical activity undertaken by the user in relation to the container. The first switch and the second switch are electrically connected to the generating mechanism such that the generating mechanism is activated to generate the special effects only when liquid is present in the container and when the predetermined physical activity is undertaken by the user.

In accordance with one feature of the present invention, the container is provided with an inner wall and an outer wall forming an annular chamber or space therebetween. The generating mechanism has a plurality of light mechanisms mounted in the chamber.

Another feature of the present invention involves providing the generating mechanism with a rotor mounted in the chamber. The rotor is connected to a motor so as to be rotated in response to the activation of the first and second switches.

In accordance with yet another feature of the present invention, the body includes a cup portion and a base portion. The base portion is adapted for housing electrical components therein and is removably attached to the cup portion. In this manner, when the cup portion needs to be washed, the base portion can be detached from the cup portion so as to prevent the electrical components from coming in contact with cleaning or washing liquid (e.g., water).

BRIEF DESCRIPTION OF THE DRAWINGS

For a more complete understanding of the present invention, reference is made to the following detailed description of exemplary embodiments considered in conjunction with the accompanying drawings, in which.

DETAILED DESCRIPTION OF THE EXEMPLARY EMBODIMENTS

Although the present invention can be used in conjunction with many different types of vessels adapted for holding liquid therein, it is particularly suitable for use in connection with a cup or mug. Accordingly, the present invention will be described hereinafter in connection with a cup or mug. It should be understood, however, that the following description is only meant to be illustrative of the present invention and is not meant to limit the scope of the present invention, which has applicability to other types of vessels.

Figure 1:
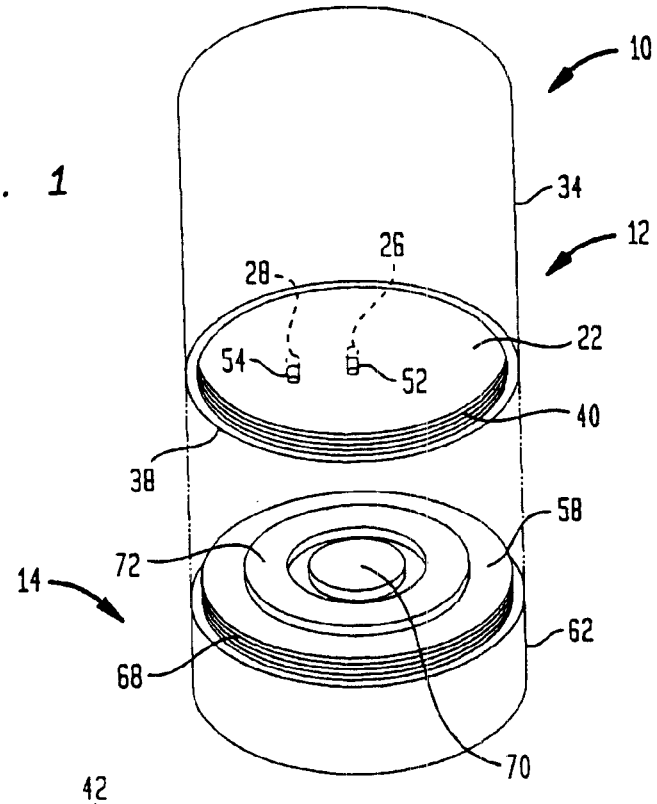
FIG. 1 is a partially exploded perspective view of a drinking vessel constructed in accordance with a first embodiment of the present invention.
Figure 2:
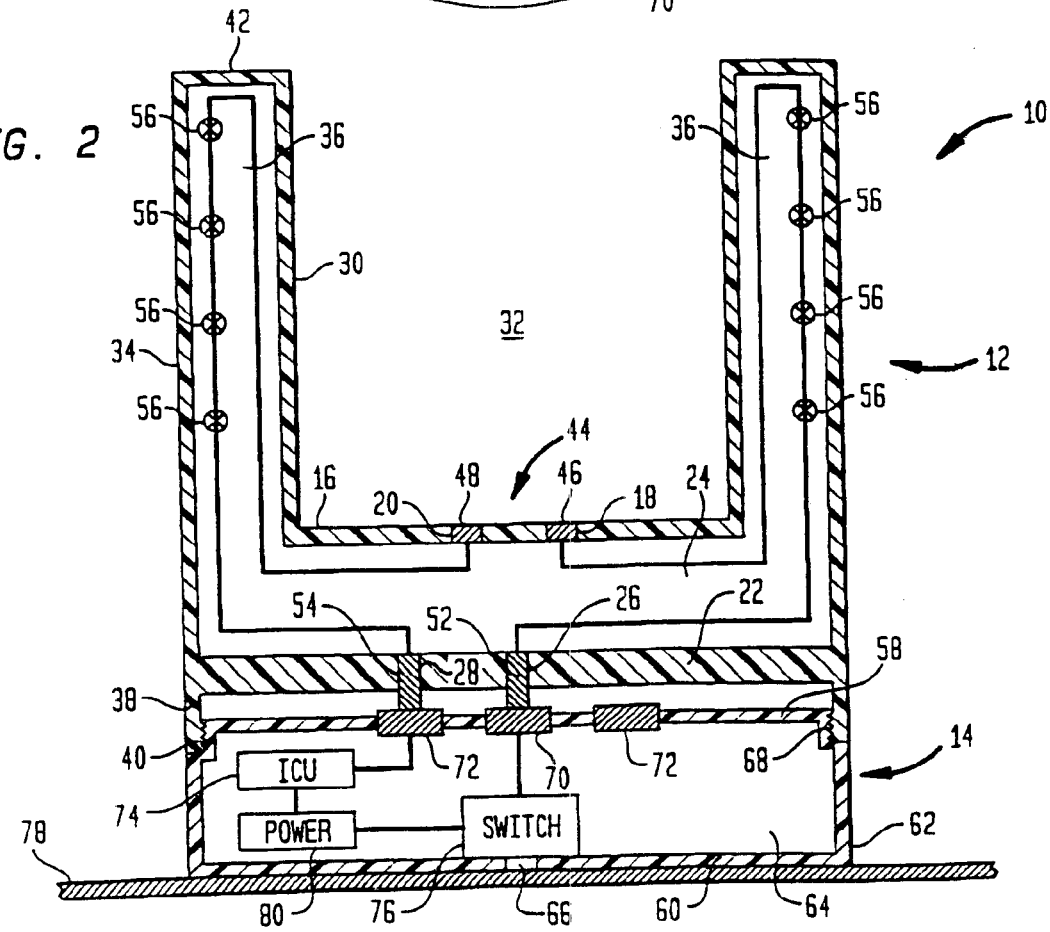
FIG. 2 is a schematic view of the drinking vessel shown in FIG. 1 and equipped with an activation switch.

FIGS. 1 and 2 show a cup 10 constructed in accordance with a first embodiment of the present invention. The cup 10 has a cup portion 12 and a base 14 removably attached to the cup portion 12. The cup portion 12 includes an upper bottom wall 16, which has a pair of holes 18, 20 therein, and a lower bottom wall 22, which is spaced from the upper bottom wall 16 so as to form a bottom chamber 24 and which has a pair of holes 26, 28. An inner cylindrical side wall 30 projects upwardly from the upper bottom wall 16 and cooperates with same so as to define a liquid holding chamber 32. An outer cylindrical side wall 34 also projects upwardly from the lower bottom wall 22 and is spaced radially outwardly from the inner side wall 30 so as to form an annular chamber 36 which communicates with the bottom chamber 24. The outer side wall 34 has a skirt 38 extending downwardly beyond the lower bottom wall 22 and having internal threads 40 thereon. An upper plate 42 connects the inner side wall 30 to the outer side wall 34 for closing off the annular chamber 36. The upper and lower bottom walls 16, 22, the inner and outer side walls 30, 34 and the upper plate 42 are connected to one another so as to make the annular chamber 36 and the bottom chamber 24 liquid-tight.

Figure 3:
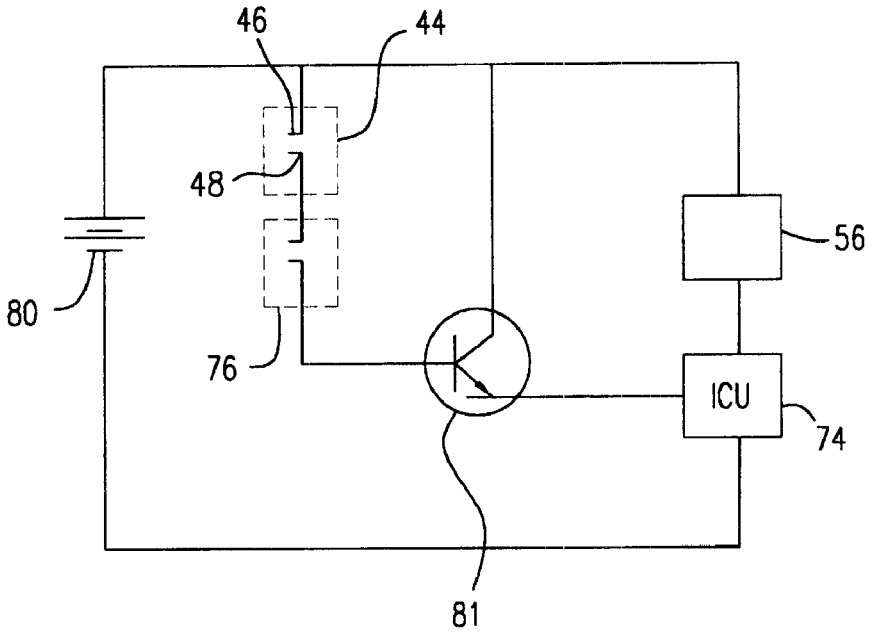
FIG. 3 is a schematic view of the electrical circuit utilized in the drinking vessel shown in FIGS. 1 and 2.

Referring to FIGS. 1 and 2, the cup portion 12 is provided with a liquid contact switch 44 having a pair of electrical contacts 46, 48 (see also FIG. 3). The contacts 46, 48 are mounted in the holes 18, 20, respectively, of the upper bottom wall 16 in a liquid-tight manner so as to prevent liquid (e.g., water) contained in the liquid holding chamber 32 from entering the bottom chamber 24. The contacts 46, 48 are adapted to come in contact with liquid in the liquid holding chamber 32 such that they can be electrically closed by same. Electrical connectors 52, 54 depend from the lower bottom wall 22 of the cup portion 12. More particularly, upper ends of the connectors 52, 54 are received in the holes 26, 28, respectively, of the lower bottom wall 22 in a liquid-tight manner so as to prevent exterior liquid from entering the bottom chamber 24.

With reference to FIGS. 2 and 3, electrical light bulbs 56 are mounted in the annular chamber 36 so as to enhance amusement when activated. In this regard, one or both of the inner and outer side walls 30, 34 is transparent or translucent such that the light bulbs 56 can be viewed through the inner side wall 30 and/or the outer side wall 34. The light bulbs 56 are serially connected to the liquid contact switch 44 and the connectors 52, 54 via electrical wires as schematically shown in FIGS. 2 and 3.

Referring back to FIGS. 1 and 2, the base 14 is sized and shaped so as to house various electrical components therein. In this regard, the base 14 has an upper wall 58, a lower wall 60 and a side wall 62 connecting the upper wall 58 to the lower wall 60 SO as to form a chamber 64. The upper, lower and side walls 58, 60, 62 are made from an opaque material such that ambient light is inhibited from entering the chamber 64. The lower wall 60 has an opening 66 formed therein for purposes to be discussed hereinafter. Threads 68, which are sized and shaped so as to mate with the threads 40 of the skirt 38 of the cup portion 12, are formed at an upper end of the base 14 for removably attaching the base 14 to the cup portion 12. A disc-shaped electrical connector 70 and a ring-shaped connector 72 project from the upper wall 58. The connectors 70, 72 are positioned on the upper wall 58 in such a manner that when the base 14 is properly attached to the cup portion 12, they come in contact with the connectors 52, 54, respectively, of the cup portion 12.

With reference to FIGS. 2 and 3, an integrated circuit unit 74 (referred to hereinafter as the "ICU") is mounted in the chamber 64 of the base 14 and is directly or indirectly connected to the connector 72. In this regard, it should be noted that FIG. 2 is a schematic illustration of the electrical components of the cup 10, the actual circuitry being depicted in FIG. 3. The ICU 74 is preprogramed so as to control the operation of the light bulbs 56 in a predetermined fashion when it is activated. An activation switch 76 is also mounted in the chamber 64 and is directly or indirectly connected to the ICU 74 and the connector 70. The activation switch 76, which is a conventional optical or photo sensor/switch, is mounted on the lower wall 60 and is aligned with the opening 66 of the lower wall 60 such that it can be activated by ambient light entering through the opening 66 when the cup 10 is lifted from an opaque supporting surface 78. In other words, the activation switch 76 is in an electrically open state (i.e., deactivated) when the cup 10 is supported on the supporting surface 78 and is in an electrically closed state (i.e., activated) when the cup 10 is lifted from same. A power source 80, such as a battery, is located in the chamber 64 and is connected to the ICU 74, while a transistor 81 (see FIG. 3) is connected to the ICU 74.

In use, the base 14 is threaded to the cup portion 12 such that the connectors 70, 72 of the base 14 are in constant contact with the connectors 52, 54, respectively, of the cup portion 12. In this manner, the light bulbs 56 and the liquid contact switch 44 of the cup portion 12 are serially connected to the ICU 74 and the activation switch 76 of the base 14. When liquid (e.g., water) is present in the liquid holding chamber 32, the contacts 46, 48 are electrically closed by same. If the cup 10 is supported on the supporting surface 78, the activation switch 76 is in an open state, thereby causing the ICU 74 to be in a deactivated state. As a result, the light bulbs 56 do not light up. When the cup 10 is lifted from the supporting surface 78, ambient light enters the opening 66 of the base 14 and activates the activation switch 76, thereby causing the activation of the ICU 74. In response, the light bulbs 56 light up in a predetermined fashion so as to generate special effects. When the cup 10 is placed back on the supporting surface 78, the activation switch 76 returns to its open state, thereby terminating the operation of the light bulbs 56. Because the liquid contact switch 44 and the activation switch 76 are connected to each other in serial fashion, when the liquid holding chamber 32 is empty (i.e., when liquid is not in the liquid holding chamber 32), the liquid contact switch 44 is in an open state and thereby prevents activation of the light bulbs 56 even if the activation switch 76 is in a closed state.

It should be appreciated that the present invention provides numerous advantages over the prior art discussed above. For instance, as described above, the liquid contact switch 44 and the activation switch 76 are connected in serial fashion. As a result, the cup 10 is adapted to generate special effects only when liquid is in the liquid holding chamber 32 and the cup 10 is lifted from a supporting surface. In other words, the cup 10 is designed in such a way that it terminates special effects when the cup 10 is empty and/or when the cup 10 is placed on a supporting surface, thereby eliminating the need to provide a timer for terminating special effects after a lapse of a predetermined time period. Moreover, because of the threaded connection between the cup portion 12 and the base 14, the cup portion 12 can be detached from the base 14 when it needs to be washed, thereby protecting the electrical components housed in the base 14 from coming in contact with washing or cleaning liquid.

It should be noted that the present invention can have numerous modifications and variations. For instance, the threads 40 of the cup portion 12 and the threads 68 of the base 14 can be replaced with any conventional mechanisms for removably connecting two components to each other (e.g., bayonet connectors). Alternatively, the cup portion 12 and the base 14 can be combined into a single, non-detachable unit, thereby eliminating the connectors 52, 54, 70, 72. The connectors 52, 54, 70, 72 can also be modified and replaced with other conventional types of electrical connectors. For example, spring-type connectors can be provided for enhancing engagement between the connectors. Further, the light bulbs 56 can be replaced with other types of light-producing mechanisms (e.g., light emitting diodes) and/or other types of special effect mechanisms (e.g., sound producing mechanisms). The light bulbs 56 can also be mounted on other parts of the cup 10, and the annular chamber 36 can thus be eliminated. Moreover, additional special effect mechanisms, such as sound-producing mechanisms, can be included in the cup 10. The base 14 can also be made from non-opaque materials if other types of activation switches (e.g., a mechanical switch) are utilized. Furthermore, the electrical circuitry of the cup 10 shown in FIG. 3 can be modified in any conventional manner to meet operational and/or manufacturing requirements. For example, while the cup 10 does not require a timer for terminating special effects upon expiration of a predetermined time period, the cup 10 can be equipped with such a timer if it is desirable to do so.

The activation switch 76 can also have many modifications and variations. That is, the activation switch 76 can be different types of switches or sensors. In this regard, FIGS. 4–7 schematically illustrate modified versions of the activation switch 76, which will be described hereinafter. For the sake of good order, it should be noted that the following description of the modified versions is meant to be illustrative of the present invention and is not meant to limit the scope of the present invention.

Figure 4:
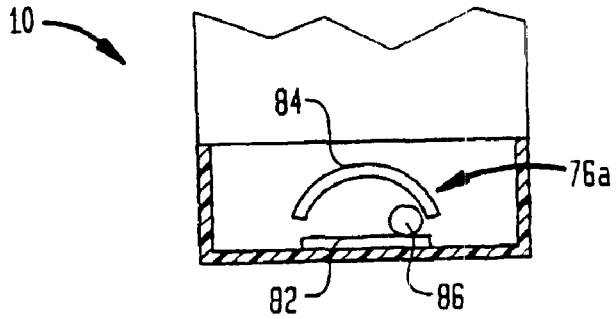
FIGS. 4–7 are schematic views of modified versions of the activation switch shown in FIG. 2.

FIG. 4 illustrates an activation switch 76*a* adapted to be activated in response to movement of the cup 10. More particularly, the activation switch has a pair of electrical contacts 82, 84, which are spaced from each other, and a ball 86, which is positioned between the contacts 82, 84 and which is made from an electrically conductive material. The ball 86 is adapted to move in response to movement of the cup 10 and to come in contact with the contacts 82, 84. The activation switch 76*a* is electrically closed when the ball 86 comes in contact with both of the contacts 82, 84.

Figure 5:
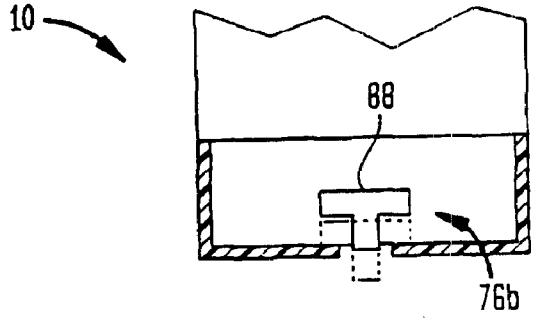

FIG. 5 illustrates an activation switch 76*b* having a movable member 88 adapted to move between an upper position (as indicated by the solid line representation of the movable member 88 in FIG. 5), in which the activation switch 76*b* is in an electrically open state, and a lower position (as indicated by the broken line representation of the movable member 88 in FIG. 5), in which the activation switch 76*b* is in an electrically closed state. When the cup 10 is placed on a supporting surface, the movable member 88 is positioned in its upper position and hence prevents the ICU 74 (not shown in FIG. 5) from activating the light bulbs 56 (not shown in FIG. 5). When the cup 10 is lifted from the supporting surface, the movable member 88 moves to its lower position via a spring or due to gravity and thereby causes the light bulbs 56 to light up if the liquid contact switch 44 (not shown in FIG. 5) is electrically closed by liquid in the liquid holding chamber 32 (not shown in FIG. 5).

Figure 6:
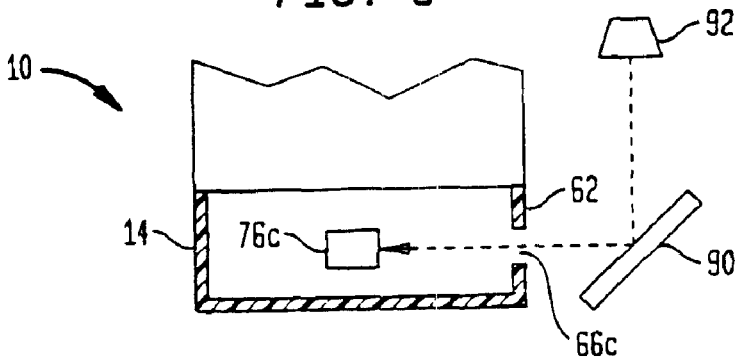

FIG. 6 illustrates a photo-sensor 76c mounted within the base 14 of the cup 10. The base 14 has an opening 66c formed in the side wall 62. An external hand-held mirror 90 is provided for activating the photo-sensor 76*c*. To activate the photo-sensor 76*c*, the mirror 90 is aligned with the opening 66*c* in such a way that a light from an external light source 92 (e.g., a lamp) is reflected to the photo-sensor 76*c* through the opening 66*c* (as indicated by the arrow in FIG. 6). Because additional user interaction (i.e., proper alignment of the mirror 90 relative to the opening 66*c*) is involved for activating the photo-sensor 76*c* and thus the ICU 74 (not shown in FIG. 6), the photo-sensor/mirror arrangement or combination discussed above provides further amusement for users of the cup 10. In this regard, it should be noted that the photosensor/mirror arrangement can be used in connection with other amusement devices or toys. For instance, a toy figure (not shown) can be equipped with the photo-sensor 76*c* and be activated by the mirror 90 to generate predetermined responses (e.g., verbal responses).

Figure 7:
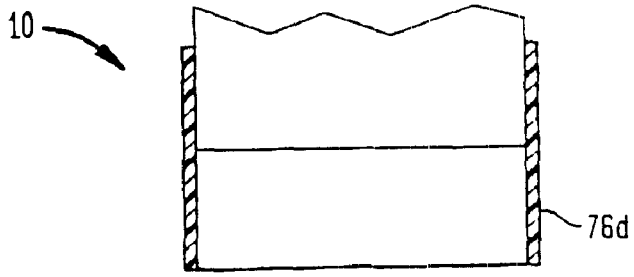

FIG. 7 illustrates a touch-sensitive activation switch 76*d* similar in construction to the switches illustrated in applicant's U.S. Pat. No. 5,648,129. More particularly, the activation switch 76*d* is mounted on the cup 10 in such a manner that when a user picks up the cup 10, his/her hand grips the activation switch 76*d*. The activation switch 76*d* is adapted to be in an electrically closed state when gripped by a user's hand and in an electrically open state when released from same.

Figure 10:
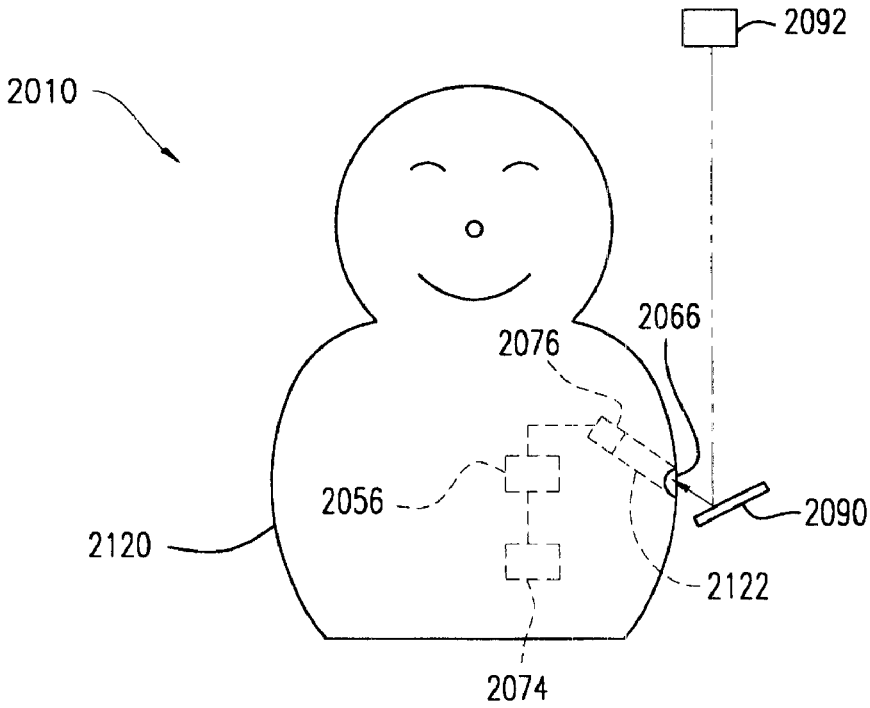
FIG. 10 is a schematic view of an amusement device constructed in accordance with a third embodiment of the present invention.
Figure 8:
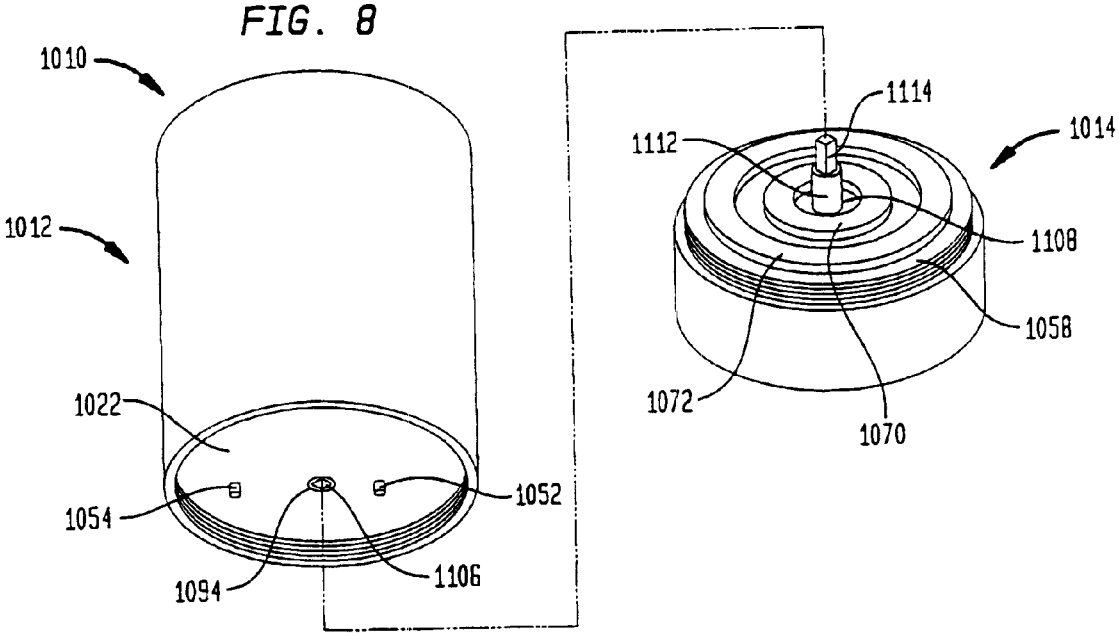
FIG. 8 is a partially exploded view of a drinking vessel constructed in accordance with a second embodiment of the present invention.
Figure 9:
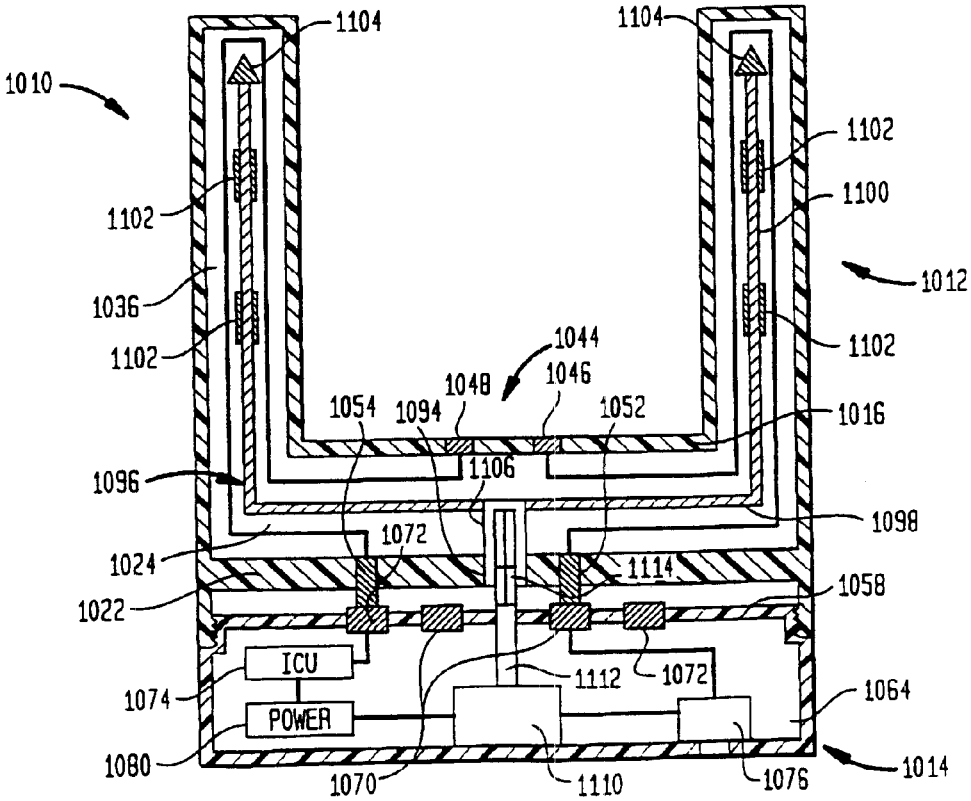
FIG. 9 is a schematic view of the drinking vessel shown in FIG. 8.

FIGS. 8 and 9 and FIG. 10 depict second and third embodiments, respectively, of the present invention. Elements illustrated in FIGS. 8 and 9 and FIG. 10, which correspond, either identically or substantially, to the elements described above with respect to the embodiment of FIGS. 1–3, have been designated by corresponding reference numerals increased by one thousand and two thousand, respectively. Unless otherwise stated, the embodiments of FIGS. 8 and 9 and FIG. 10 are constructed and assembled in the same basic manner as the embodiment of FIGS. 1–3.

Referring to FIGS. 8 and 9, a cup 1010 constructed in accordance with a second embodiment of the present invention includes a cup portion 1012 and a base 1014 removably attached to the cup portion 1012. A liquid contact switch 1044, which has a pair of electrical contacts 1046, 1048, is mounted in an upper bottom wall 1016 of the cup portion 1012, while electrical connectors 1052, 1054 depend from a lower bottom wall 1022 of the cup portion 1012. An opening 1094 is formed in the lower bottom wall 1022 for purposes to be discussed hereinafter. A rotor 1096 is rotatably mounted in annular and bottom chambers 1036, 1024 of the cup portion 1012. More particularly, the rotor 1096 has a base section 1098, which is positioned in the bottom chamber 1024, and a column 1100, which is located in the annular chamber 1036 and which is connected to the base section 1098 for conjoint rotation therewith. Indicia 1102 and figures 1104 are provided on the column 1100 for providing additional amusement. Light bulbs (not shown in FIGS. 8 and 9) can also be mounted on the column 1100 and/or on the cup portion 1012. A link 1106 is attached to the base section 1098 and extends into the opening 1094.

Still referring to FIGS. 8 and 9, the base 1014 has an opening 1108 formed on an upper wall 1058 of the base 1014. Ring shaped electrical connectors 1070, 1072 are mounted in or on the upper wall 1058 for connection with the connectors 1052, 1054, respectively. An integrated circuit unit (ICU) 1074, a power source 1080 and an activation switch 1076 are mounted in a chamber 1064 of the base 1014. An electric motor 1110 is mounted in the chamber 1064 and is electrically connected to the ICU 1074 and the activation switch 1076. The motor 1110 has a rod 1112 extending through the opening 1108. The rod 1112 has an end 1114 sized and shaped so as to removably engage the link 1106 for rotating the rotor 1096 when the motor 1110 is activated. The motor 1110 is activated when both of the liquid contact switch 1044 and the activation switch 1076 are closed (i.e., when liquid is in the cup 1010 and when the cup 1010 is lifted from a supporting surface).

FIG. 10 shows an amusement device 2010 constructed in accordance with a third embodiment of the present invention. More particularly, the amusement device 2010 includes a body 2120 which can be in the shape of a person, animal or thing. The body 2120 includes an opening 2066 and a passageway 2122 communicating with the opening 2066 and angled downwardly. Alternatively, the passageway 2122 can be oriented in a different manner (e.g., the passageway 2122 can be oriented horizontally). An optical sensor 2076 is housed in the passageway 2122, while an ICU 2074 and a special effect-generating mechanism 2056, such as light units, sound-generating units, motorized motion units, are housed in or mounted on the body 2120. The optical sensor 2076 is connected to the ICU 2074 and the special effect-generating mechanism 2056 such that when the optical sensor 2076 is activated, the special effect-generating mechanism 2056 is activated to produce preprogramed special effects (e.g., sounds, lights and movement). An external mirror 2090 is provided for reflecting a light beam from an external light source 2092 or an ambient light to the optical sensor 2076 through the opening 2066 and the passageway 2122.

In use, a user holds the mirror 2090 in his/her hand and manipulates same so as to direct a light beam from the light source 2092 into the opening 2066. When a light beam is received by the optical sensor 2076 through the opening 2066 and the passageway 2122, the ICU 2074, and hence the special effect-generating mechanism 2056, are activated, thereby producing preprogramed special effects. Due to the interaction involved between the user and the device 2010, the device 2010 provides enhanced amusement to the user. Because the passageway 2122 is oriented downwardly, accidental activation of the optical sensor 2076 is minimized.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A drinking vessel comprising a container sized and shaped so as to hold liquid therein; generating means for generating electrically generated special effects so as to enhance amusement for a user; a first switch mounted on said container so as to be operable between a first state, in which said first switch is in an electrically closed state, and a second state, in which said first switch is in an electrically open state, said first switch being in said first state when liquid is present in said container and in said second state when liquid is not present in said container; and a second switch mounted on said container so as to be operable between a third state, in which said second switch is in an electrically closed state, and a fourth state, in which said second switch is in an electrically open state, said second switch being in said third state in response to a predetermined physical activity undertaken by the user in relation to said container, said first switch and said second switch being electrically connected to said generating means such that said generating means is activated to generate the special effects only when liquid is present in said container and when the predetermined physical activity is undertaken by the user, said second switch being in said third state in response to the lifting of said container from a supporting surface, and said second switch including a mechanical switch housed in said container.

2. The drinking vessel of claim 1, wherein said container includes a container portion and a base portion removably attached to said container portion, said first switch being located on said container portion, said second switch being located on said base portion, said first and second switches being electrically connected to one another in serial fashion when said base portion is attached to said container portion and being electrically disconnected from one another when said base portion is detached from said container portion, whereby said second switch can be removed from said container portion together with said base portion.

3. The drinking vessel of claim 2, further comprising a connector mechanism mounted on said container for electrically connecting said first switch to said second switch when said base portion is attached to said container portion.

4. A drinking vessel comprising a container sized and shaped so as to hold liquid therein; generating means for generating electrically generated special effects so as to enhance amusement for a user; a first switch mounted on said container so as to be operable between a first state, in which said first switch is in an electrically closed state, and a second state, in which said first switch is in an electrically open state, said first switch being in said first state when liquid is present in said container and in said second state when liquid is not present in said container; a second switch mounted on said container so as to be operable between a third state, in which said second switch is in an electrically closed state, and a fourth state, in which said second switch is in an electrically open state, said second switch being in said third state in response to a predetermined physical activity undertaken by the user in relation to said container, said first switch and said second switch being electrically connected to said generating means such that said generating means is activated to generate the special effects only when liquid is present in said container and when the predetermined physical activity is undertaken by the user, said container including a container portion and a base portion removably attached to said container portion, said first switch being located on said container portion, said second switch being located on said base portion, said first and second switches being electrically connected to one another in serial fashion when said base portion is attached to said container portion and being electrically disconnected from one another when said base portion is detached from said container portion, whereby said second switch can be removed from said container portion together with said base portion; and a connector mechanism mounted on said container for electrically connecting said first switch to said second switch when said base portion is attached to said container portion, said connector mechanism including at least one first connector, which is mounted on said container portion and which is connected to said first switch, and at least one second connector, which is mounted on said base portion and which is connected to said second switch, and said at least one first connector being in contact with said at least one second connector when said base portion is attached to said container portion and being out of contact with said at least one second connector when said base portion is detached from said container portion.

5. The drinking vessel of claim 4, wherein said container portion includes a bottom having a first upper wall and a first lower wall spaced from said first upper wall, said at least one first connector includes third and fourth connectors mounted on said first lower wall; wherein said base portion includes a second upper wall and a second lower wall spaced from said second upper wall, said at least one second connector includes fifth and sixth connectors mounted on said second upper wall such that said fifth and sixth connectors are in contact with said third and fourth connectors, respectively, when said base portion is attached to said container portion.

6. The drinking vessel of claim 5, wherein said fifth and sixth connectors are concentrically mounted on said second upper wall of said base portion, said fifth connector being positioned radially inwardly from said sixth connector.

7. The drinking vessel of claim 6, wherein said fifth connector has a cylindrical shape; and wherein said sixth connector has a ring shape.

8. The drinking vessel of claim 6, wherein each of said fifth and sixth connectors has a ring shape.

9. The drinking vessel of claim 1, wherein said container has inner and outer side walls spaced from each other so as to form a space therebetween, at least one of said inner and outer side walls being made from a light-transmitting material.

10. The drinking vessel of claim 9, wherein said generating means includes light units mounted in said space such that said light units can be viewed through said at least one of said inner and outer side walls.

11. A drinking vessel comprising a container sized and shaped so as to hold liquid therein; generating means for generating electrically generated special effects so as to enhance amusement for a user; a first switch mounted on said container so as to be operable between a first state, in which said first switch is in an electrically closed state, and a second state, in which said first switch is in an electrically open state, said first switch being in said first state when liquid is present in said container and in said second state when liquid is not present in said container; and a second switch mounted on said container so as to be operable between a third state, in which said second switch is in an electrically closed state, and a fourth state, in which said second switch is in an electrically open state, said second switch being in said third state in response to a predetermined physical activity undertaken by the user in relation to said container, said first switch and said second switch being electrically connected to said generating means such that said generating means is activated to generate the special effects only when liquid is present in said container and when the predetermined physical activity is undertaken by the user, said generating means including a rotor rotatably mounted in said container, said rotor being rotated when said first and second switches are in said first and third states, respectively, and at least one portion of said container being made from a light-transmitting material such that at least one section of said rotor can be viewed through said at least one portion of said container.

12. The drinking vessel of claim 11, wherein said generating means includes rotating means for rotating said rotor.

13. The drinking vessel of claim 12, wherein said container includes a container portion and a base portion removably attached to said container portion, said rotor being rotatably mounted in said container portion, said rotating means including an electric motor housed in said base portion, said generating means including interconnecting means for releasably interconnecting said motor to said rotor such that said motor can be disconnected from said rotor when said base portion is detached from said container portion.

14. The drinking vessel of claim 13, wherein said interconnecting means includes a link attached to said rotor, said motor having a shaft which includes an end sized and shaped so as to releasably engage said link.

15. The drinking vessel of claim 11, wherein said container includes inner and outer side walls spaced from each other so as to form a space therebetween; and said rotor includes a column rotatably mounted in said space and having indicia thereon for amusement, at least one of said inner and outer side walls being made from a light-transmitting material such that said column can be viewed through said at least one of said inner and outer side walls.

16. A drinking vessel comprising a container sized and shaped so as to hold liquid therein; generating means for generating electrically generated special effects so as to enhance amusement for a user; a first switch mounted on said container so as to be operable between a first state, in which said first switch is in an electrically closed state, and a second state, in which said first switch is in an electrically open state, said first switch being in said first state when liquid is present in said container and in said second state when liquid is not present in said container; and a second switch mounted on said container so as to be operable between a third state, in which said second switch is in an electrically closed state, and a fourth state, in which said second switch is in an electrically open state, said second switch being in said third state in response to a predetermined physical activity undertaken by the user in relation to said container, said first switch and said second switch being electrically connected to said generating means such that said generating means is activated to generate the special effects only when liquid is present in said container and when the predetermined physical activity is undertaken by the user, said second switch being in said third state in response to the lifting of said container from a supporting surface, said second switch including an optical sensor mounted in said container, said container having an opening aligned with said optical sensor, said opening being covered by the supporting surface when said container is placed on the supporting surface, whereby said optical sensor is deactivated, and said opening being exposed when said container is lifted from the supporting surface, whereby said optical sensor is activated.

17. The drinking vessel of claim 1, wherein said second switch is in said third state in response to movement of said container, said second switch including a pair of contacts and a ball movably mounted between said contacts for electrically closing said contacts.

18. A drinking vessel comprising a container sized and shaped so as to hold liquid therein, said container including an opening; generating means for generating electrically generated special effects so as to enhance amusement for a user; a first switch mounted on said container so as to be operable between a first state, in which said first switch is in an electrically closed state, and a second state, in which said first switch is in an electrically open state, said first switch being in said first state when liquid is present in said container and in said second state when liquid is not present in said container; and a second switch mounted on said container so as to be operable between a third state, in which said second switch is in an electrically closed state, and a fourth state, in which said second switch is in an electrically open state, said second switch being in said third state in response to a predetermined physical activity undertaken by the user in relation to said container, said first switch and said second switch being electrically connected to said generating means such that said generating means is activated to generate the special effects only when liquid is present in said container and when the predetermined physical activity is undertaken by the user, said second switch including an optical sensor mounted in said container, and said optical sensor being located in said container so as to be actuated by a light beam reflected thereto through said opening by a mirror held by the user.

19. The drinking vessel of claim 1, wherein said second switch is in said third state in response to the gripping of said container by the user.

20. The drinking vessel of claim 19, wherein said second switch includes a touch-sensitive switch mounted on said container, said touch-sensitive switch being in a closed state when said touch-sensitive switch gripped by the user.

21. The drinking vessel of claim 1, wherein said first switch includes a pair of contacts mounted on said container so as to come in contact with and be electrically closed by the liquid.

22. An amusement device comprising a body having an opening formed therein, said body being in the form of a drinking vessel and including a downwardly oriented passageway; generating means for generating electrically generated special effects so as to enhance amusement for a user; an optical sensor operable between activated and deactivated states, said optical sensor activating said generating means when said optical sensor is in said activated state, said optical sensor being located in said passageway of said body such that a light beam can be transmitted to said optical sensor through said opening of said body from a light source located exterior to said body; and a reflective member located exterior to said body and including a mirror, said reflective member being sized and shaped so as to be held by a user's hand and to be manipulated by the user for reflecting a light beam from the light source to said optical sensor through said opening, said optical sensor being in said activated state when a light beam is reflected thereto from the light source through said opening.

* * * * *